United States Patent [19]

Aris et al.

[11] Patent Number: 4,834,579

[45] Date of Patent: May 30, 1989

[54] WATERPROOFING DAMS AND THE LIKE

[75] Inventors: Raphaël Aris, Saint Cloud; Pierre Couprie, Paris; Daniel Gouvenot, Clichy, all of France

[73] Assignee: Soletanche, Societe Anonyme Dite, Nanterre, France

[21] Appl. No.: 123,932

[22] Filed: Nov. 23, 1987

[30] Foreign Application Priority Data

Nov. 25, 1986 [FR] France ..... 86 16398

[51] Int. Cl.[4] ..... E02B 7/04

[52] U.S. Cl. ..... 405/109; 405/116

[58] Field of Search ..... 405/107, 109, 116, 117, 405/267

[56] References Cited

U.S. PATENT DOCUMENTS

| | | | |
|---|---|---|---|
| 922,207 | 5/1909 | Strauss | 405/109 |
| 1,808,904 | 6/1931 | Noetzli | 405/116 |

FOREIGN PATENT DOCUMENTS

| | | | |
|---|---|---|---|
| H15665 | 8/1956 | Fed. Rep. of Germany | 405/109 |
| 1060329 | 6/1959 | Fed. Rep. of Germany | 405/109 |
| 1634140 | 4/1971 | Fed. Rep. of Germany . | |
| 2809175 | 9/1979 | Fed. Rep. of Germany . | |
| 2164151 | 7/1973 | France . | |
| 2231231 | 12/1974 | France . | |
| 897923 | 1/1982 | U.S.S.R. | 405/109 |
| 968151 | 10/1982 | U.S.S.R. | 405/109 |

*Primary Examiner*—David H Corbin

*Attorney, Agent, or Firm*—Schweitzer & Cornman

[57] ABSTRACT

A dam formed of roll-compacted concrete having an upstream side and a downstream side is provided with an impermeable membrane curtain. The curtain includes a vertical planar wall portion extending for the full depth of the dam and transversely for the full width of the dam. A series of vertical ribs are connected to and spaced transversely along the curtain. The ribs project toward the upstream side of the dam and extend for the full depth of the dam.

6 Claims, 1 Drawing Sheet

WATERPROOFING DAMS AND THE LIKE

Figure 1:
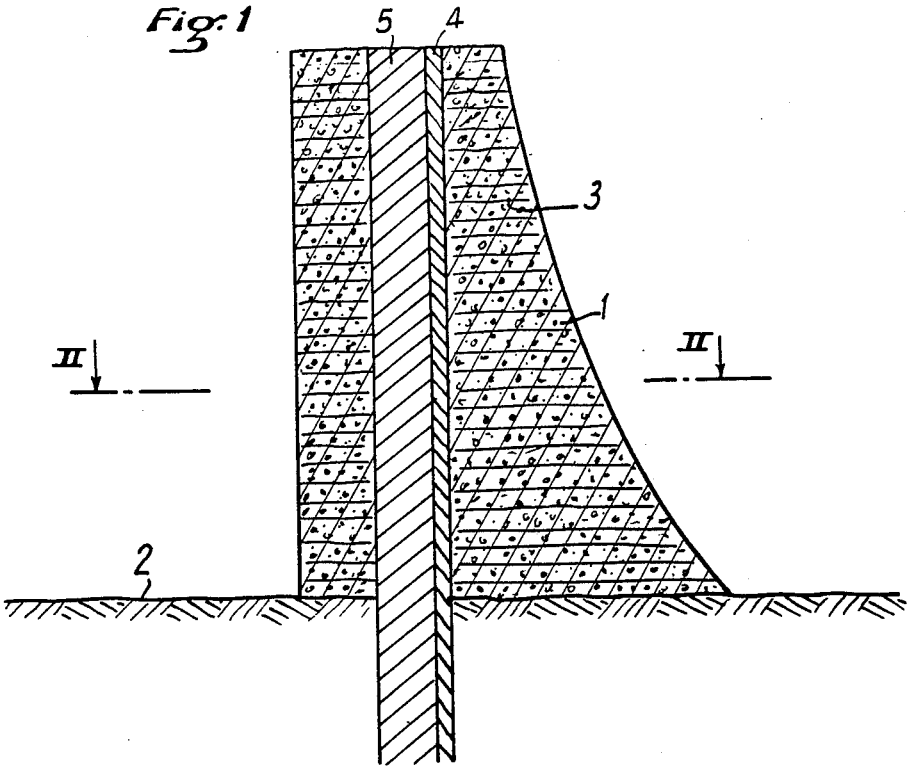

The present invention relates to a waterproofing curtain for a dam made particularly of roll compacted concrete.

Roll compacted concrete dams are made by means of earthmoving equipment which pours the material in successive passes several tens of centimeters thick. The finished dam is therefore constituted by a pile of layers of concrete, and it can be considered that in each layer there is a repouring of concrete.

Since each repouring of concrete can be the source of leakage, means have already been devised to assure the waterproof character of the dam.

For this purpose, the construction has first of all been organized such that while a layer is being poured the layer below it has not yet finished setting. Thus, the hydraulic binder included in a layer can combine with that of the layer below at the interface between the two layers. The roll compacted dam thus obtained can be considered homogenous.

This method, however, has the disadvantage of not being compatible with all the hydraulic binders, on account of setting time problems, and furthermore it requires very strict organization of the work.

It is for this reason that various supplemental waterproofing systems have been proposed to enable the dam to be made in the form of a stack of independent and permeable roll compacted concrete layers.

Thus, waterproof membranes have been made on the upstream face of the dam, completed by a drainage system.

It has also been proposed to make a watertight membrane within the dam, and it is to this latter type of waterproofing that the invention relates.

This device also permits using for the body of the dam a material of lesser quality, particularly as regards its permeability.

In fact, it has been found that, in case of a rapid draw-down, the upstream plane of the waterproof membrane does not have time to drain, so that a block of the dam situated immediately upstream from the membrane is not stable.

The present invention aims to remedy these disadvantages by furnishing a waterproofing curtain such that, even in the case of rapid draw-down, the dam will remain stable.

To this effect the invention first of all has as its subject a waterproofing curtain for dams, made particularly of roll compacted concrete, of the type having a substantially vertical membrane sunk transversely within the dam, characterized by the fact that it includes a plurality of substantially vertical ribs connected to the said membrane and projecting from the latter from the upstream side of the dam.

The ribs permit the achievement of a bond by adherence between the waterproof membrane and the portion of the dam immediately upstream of this membrane. A decidedly superior stability is thus obtained since the horizontal thrust of the water against the membrane is balanced by adherence along the faces of the ribs.

These ribs can be substantially planar walls, or also they can have a horizontal cross section with a wider part facing upstream from the dam, for example in dovetail form or in a T shape.

The dovetail-shaped ribs have superior adherence and therefore enable stability to be further improved.

The ribs are advantageously made of draining material.

The present invention also has as its subject matter a dam characterized by the fact that it includes at least one waterproofing curtain as described above.

The membrane and the ribs can be made by any known means, but advantageously they are made in the form of cast walls.

Figure 2:
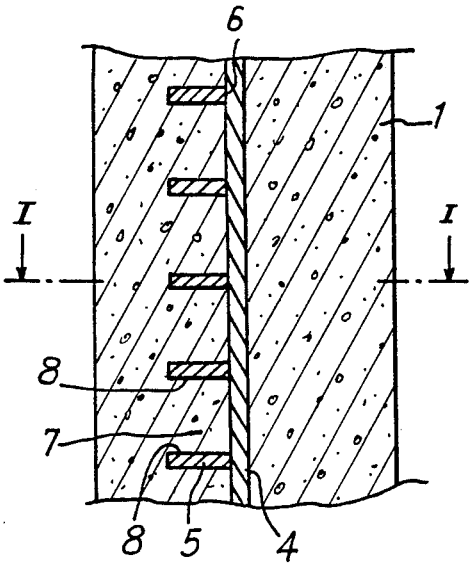
Figure 3:
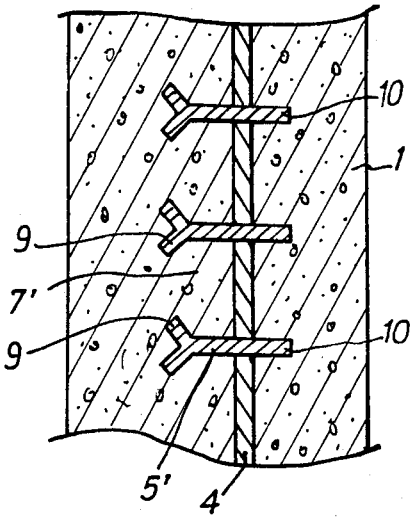

Particular embodiments of the invention will now be described by means of nonlimitative examples, with reference to the appended schematic drawings wherein:

FIG. 1 is a cross-sectional view along the line I—I of FIG. 2, of a dam made according to the invention, FIG. 2 is a cross section along line II—II of FIG. 1, and FIG. 3 is a view similar to FIG. 2 representing another embodiment.

The dam of FIGS. 1 and 2 is constituted by a stack of layers 1 or roll compacted concrete placed on the ground 2.

The planes of the concrete pourings 3 formed between two adjacent layers of concrete 1 are therefore potential sources of leakage.

To assure the watertightness of the dam a substantially vertical watertight membrane 4 is made, which is disposed transversely within the dam.

To assure the stability of the dam, and more particularly of the portion of the dam directly upstream of the membrane 4, ribs 5, also vertical, and perpendicular to the membrane 4 are provided, and connected to the latter along their downstream edge 6. The bond between the ribs 5 and the membrane 4 is provided by any known means.

The ribs 5 project from the membrane 4 on the upstream side of the dam, so that two consecutive ribs define between them a block 7 of the dam to which they are bound by adherence along their faces 8. The block 7 is thus stabilized, particularly in the case of a rapid draw-down in which the upstream plane of the membrane 4 does not have time to drain.

In the embodiment in FIG. 3, the ribs 5' have a dovetail-shaped horizontal cross section flaring out from the upstream side of the dam. Two consecutive ribs 5' thus have their adjacent wings 9 which form an abutment for the dam block 7' between two ribs. Adherence is thus improved, and with it the stability of the dam.

Furthermore, the ribs 5' have prolongations 10 on the side of the waterproof membrane 4 in order to strengthen the upstream and downstream portions of the dam.

The ribs 5 and 5' are made of any suitable materials, but preferably of a draining material that can be connected to the drainage system of the dam.

Preferably the membrane and the ribs are made in the form of cast walls. For this purpose any suitable apparatus can be used, such as a skip for digging the trenches corresponding to these walls. Nevertheless, a rotary cutter is preferably used, which is better adapted to work in roll compacted concrete.

Different variants and modifications can, of coure, be made in the foregoing description without departing from the scope and spirit of the invention.

Likewise, the use of the curtain according to the invention is not limited to roll compacted concrete dams. On the contrary, such a curtain can, in certain cases, permit using less expensive materials such as lean concrete or concrete containing ordinary quality aggregate such as may be found at the dam site.

We claim:

1. A dam comprising strata of consecutively poured layers of roll-compacted concrete having an upstream side and a downstream side separated by an impermeable membrane curtain, (a) said membrane curtain extending vertically for the full depth of said dam from its uppermost stratum to its lowermost stratum and extending transversely across the entire width of said dam;

(b) said curtain comprising a vertical planar wall portion extending for the full depth of the dam and transversely for the full width of the dam and a series of vertical ribs connected to and spaced transversely along said curtain and extending for the full depth of said dam; and, (c) said ribs projecting toward the upstream side of said dam.

2. A dam according to claim 1, characterized by the fact that the said ribs are substantially planar walls.

3. A dam according to claim 1, characterized by the fact that the said ribs have a horizontal cross section having a wider portion directed to upstream sides of the dam.

4. A dam according to claim 1, characterized by the fact that said ribs are made of draining material.

5. A dam according to claim 1, characterized by the fact that said ribs and said vertical planar wall are made of cast material.

6. A dam according to claim 1, characterized by the fact that said ribs have Y-shaped profiles facing upstream and projecting tail portions extending to the downstream side of the dam.

* * * * *